US007234585B2

(12) United States Patent
Draghetti et al.

(10) Patent No.: US 7,234,585 B2
(45) Date of Patent: Jun. 26, 2007

(54) PERFECTED DRUM FOR FILTER-TIPPED CIGARETTE MANUFACTURING MACHINES

(75) Inventors: Fiorenzo Draghetti, Medicina (IT); Andrea Montanari, Monte San Pietro (IT)

(73) Assignee: G.D Societa' per Azioni, Bologna (IT)

( * ) Notice: Subject to any disclaimer, the term of this patent is extended or adjusted under 35 U.S.C. 154(b) by 225 days.

(21) Appl. No.: 10/990,483

(22) Filed: Nov. 18, 2004

(65) Prior Publication Data

US 2005/0139453 A1 Jun. 30, 2005

(30) Foreign Application Priority Data

Nov. 19, 2003 (IT) ..... BO2003A0693

(51) Int. Cl.
*B65G 17/46* (2006.01)

(52) U.S. Cl. ..... 198/471.1; 198/781.02

(58) Field of Classification Search ..... 198/471.1, 198/474.1, 478.1, 781.01, 781.02
See application file for complete search history.

(56) References Cited

U.S. PATENT DOCUMENTS 1,611,912 A * 12/1926 Hleb ..... 403/7
3,498,653 A * 3/1970 McCreery ..... 403/322.2
4,438,774 A 3/1984 Dyett et al.
4,746,006 A * 5/1988 Nixon et al. ..... 198/458
4,913,170 A * 4/1990 Conti ..... 131/282
5,402,802 A * 4/1995 Kakiuchi et al. ..... 131/94
5,984,851 A 11/1999 Irikura
6,064,032 A * 5/2000 Voss et al. ..... 219/121.67
6,513,781 B1 * 2/2003 Meyer et al. ..... 248/544
7,104,389 B2 * 9/2006 Jendrian ..... 198/471.1

FOREIGN PATENT DOCUMENTS

EP 1 108 369 A 6/2001
EP 1 518 468 A2 3/2005

* cited by examiner

*Primary Examiner*—Douglas Hess
(74) *Attorney, Agent, or Firm*—Birch, Stewart, Kolasch & Birch, LLP

(57) ABSTRACT

A drum for a filter-tipped cigarette manufacturing machine is fitted to and projects from a frame of the manufacturing machine, and has a drive shaft; an outer shell connected in angularly fixed and axially sliding manner to the drive shaft; and an axial guide member interposed between the shell and the drive shaft, and connected telescopically to the drive shaft to enable the shell to be withdrawn axially from the frame, from a work position power-connected angularly to the drive shaft, while still remaining supported by the drive shaft; the drum also has a device for releasably locking the shell, in the work position, axially to the drive shaft.

16 Claims, 4 Drawing Sheets

PERFECTED DRUM FOR FILTER-TIPPED CIGARETTE MANUFACTURING MACHINES

The present invention relates to a perfected drum for filter-tipped cigarette manufacturing machines.

BACKGROUND OF THE INVENTION

More specifically, the present invention relates to a drum, for filter-tipped cigarette manufacturing machines, of the type fitted to and projecting from a frame of the manufacturing machine, and comprising a drive shaft, and an outer shell supported by the drive shaft, fitted to the drive shaft to rotate with the drive shaft about an axis, and having a number of external axial seats, each for retaining a respective elongated tobacco article.

Filter-tipped cigarette manufacturing machines are known to employ a succession of rotary drums projecting from a normally vertical front surface of the manufacturing machine frame, and which provide for receiving a succession of double cigarette portions; feeding the double cigarette portions through a cutting station to obtain a succession of pairs of single cigarette portions; axially parting the single cigarette portions in each pair; inserting a double filter between the single cigarette portions in each pair to form a group; connecting, by rolling, the elements in the group by means of a gummed strip to obtain a double cigarette; and feeding the double cigarettes through a cutting station to obtain a succession of pairs of finished filter-tipped cigarettes.

All the above operations are normally accompanied by fallout of a fairly large amount of powdered tobacco, which settles at least partly on the rotary drums, thus calling for frequent maintenance and cleaning of the drums. This applies in particular to rotary drums for rolling on and treating the gummed strips, on which gum is also added to the powdered tobacco.

Since each rotary drum is tangent to at least one other rotary drum, the space about each drum is normally so confined that any maintenance or cleaning can only be done by partly dismantling the drum or the adjacent drums, which involves a good deal of downtime.

SUMMARY OF THE INVENTION

It is an object of the present invention to provide a drum for a filter-tipped cigarette manufacturing machine, designed to eliminate the aforementioned drawback, and which provides, in a straightforward, low-cost manner, for relatively fast maintenance and cleaning.

According to the present invention, there is provided a drum for a filter-tipped cigarette manufacturing machine, the drum being fitted to and projecting from a frame of said manufacturing machine, and comprising a drive shaft, and an outer shell supported by the drive shaft, connected to the drive shaft to rotate, with the drive shaft, about an axis, and having a number of external axial seats, each for retaining a respective elongated tobacco article; and being characterized in that the shell is connected in axially sliding manner to the drive shaft; axial guide-slide means being interposed between the shell and the drive shaft to permit axial travel of the shell, with respect to the drive shaft, between a withdrawn work position and an extracted maintenance position, in which the shell remains supported by the drive shaft; and releasable locking means being provided to lock the shell axially to the drive shaft in said withdrawn work position.

BRIEF DESCRIPTION OF THE DRAWINGS

A non-limiting embodiment of the present invention will be described by way or example with reference to the accompanying drawings, in which.

DETAILED DESCRIPTION OF THE INVENTION

Figure 1:
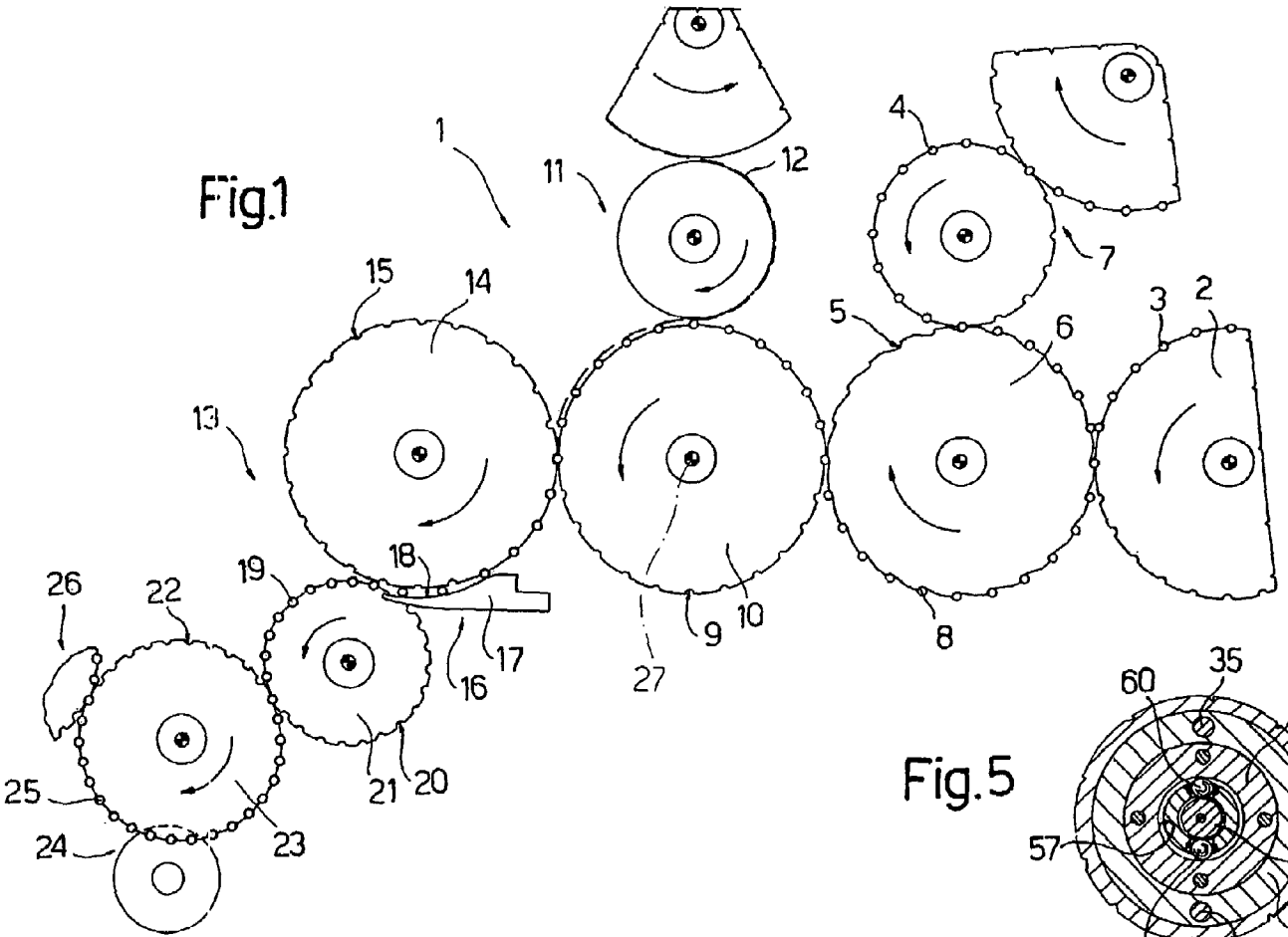
FIG. 1 shows a schematic partial side view of a filter-assembly machine.
Figure 5:
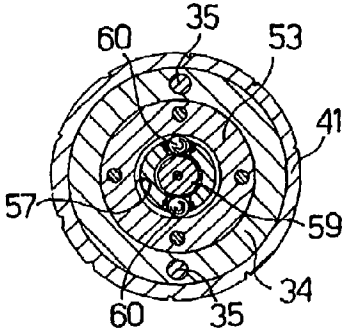
FIG. 5 shows a section along line V—V in FIG. 2.

Number 1 in FIG. 1 indicates as a whole a filter assembly machine, a functionally known central portion of which comprises a known parting drum 2 for feeding two aligned cigarette portions 3, spaced axially apart by a distance equal to the length of a double filter 4, in known manner into a respective seat 5 of a drum 6 and on either side of a relative double filter 4, fed beforehand into seat 5 by a known line 7 for supplying double filters 4, so as to form, inside seat 5, a group 8 comprising two cigarette portions 3 separated by a double filter 4.

Groups 8 are fed successively by drum 6 into seats 9 of a drum 10, which feeds groups 8 successively through a loading station 11 for loading a succession of strips 12, each for integrally connecting cigarette portions 3 and double filter 4 of a respective group 8.

A known rolling unit 13 is located immediately downstream from drum 10, and comprises a drum 14 in turn comprising seats 15, each for receiving a relative group 8 and a relative strip 12 in known manner from drum 10. Drum 14 feeds groups 8 and relative strips 12 to a rolling station 16, which is defined by a fixed plate 17 facing the outer periphery of drum 14 and defining, with the periphery of drum 14, a rolling channel 18, inside which each group 8 rolls backwards about its axis and out of relative seat 15 to wind relative strip 12 about relative double filter 4 and about the end portions, facing double filter 4, of relative cigarette portions 3 to obtain a double cigarette 19.

On reaching the end of plate 17, double cigarettes 19 are transferred into respective seats 20 of a drum 21, and then into respective seats 22 on a drum 23, which feeds double cigarettes 19 through a cutting unit 24, which cuts double cigarettes 19 into half to obtain, from each double cigarette 19, two coaxial single cigarettes 25 positioned with their filters facing and contacting end to end, and which are then transferred to an output portion 26 of filter assembly machine 1.

Figure 2:
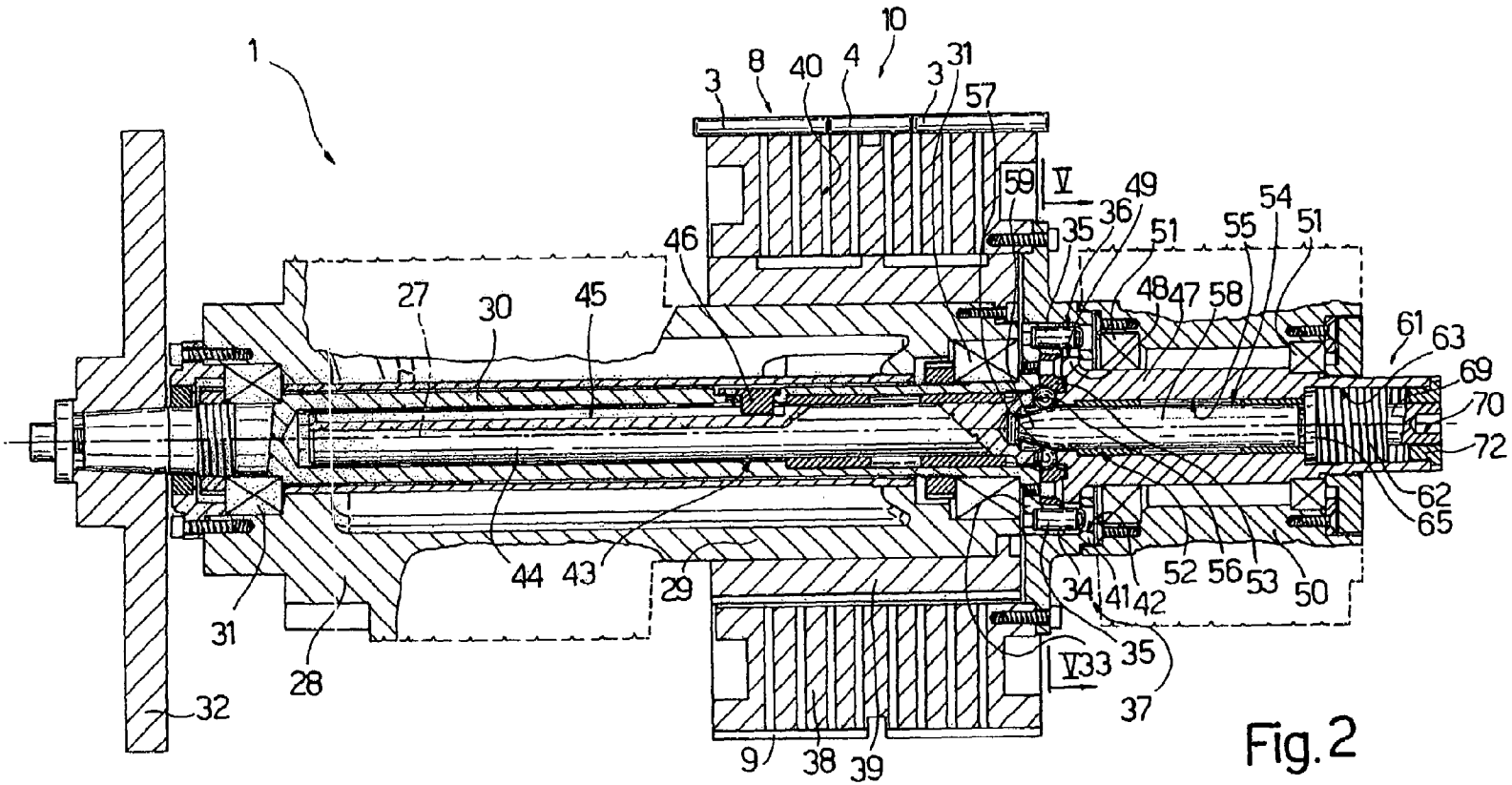
FIG. 2 shows a section of a preferred embodiment of the drum according to the present invention in a first configuration.

Drum 10 has an axis 27 of rotation perpendicular to the FIG. 1 plane, and, as shown in FIG. 2, is fitted to a fixed tubular frame 28 forming part of a frame of filter assembly machine 1, and which is coaxial with axis 27 and comprises an axial tubular appendix 29 at the front.

Drum 10 comprises a tubular drive shaft 30 coaxial with axis 27, fitted in rotary manner through frame 28 and to relative tubular appendix 29 with the interposition of bearings 31, and comprising a rear portion which projects rearwards of frame 28 and is fitted with a flange 32 for connection to a main drive device (not shown) of filter assembly machine 1. Drive shaft 30 also comprises a front portion projecting frontwards of tubular appendix 29 and terminating with a substantially circular flange 33, which is coaxial with axis 27 and fitted with a peripheral tubular front appendix 34 coaxial with axis 27 and housing two pins 35 parallel to axis 27.

Pins 35 form part of a pin-and-socket type joint 36 for transmitting drive torque from drive shaft 30 to part of an assembly 37, which is movable axially, with respect to drive shaft 30, between a normal withdrawn work position (FIGS. 2 and 3) and an extracted maintenance position (FIG. 4), and comprises a cylindrical shell 38 coaxial with axis 27 and fitted in rotary manner, in said normal withdrawn position, to tubular appendix 29 with the interposition of a pneumatic distributor 39 integral with tubular appendix 29. On the outside, shell 38 has seats 9, inside which relative groups 8 are retained by suction by means of radial channels 40 interposed between pneumatic distributor 39 and seats 9, and, at the front end, has an inner flange 41 forming part of joint 36 and comprising two through holes 42, each engaged by the end of a relative pin 35.

Assembly 37 also comprises a central shaft 43 coaxial with axis 27 and in turn comprising a cylindrical rear portion 44 extending inside drive shaft 30 and having an axial groove 45, which is closed by shoulders at opposite ends and engaged by a tongue 46 integral with drive shaft 30, projecting inwards from drive shaft 30, and defining both the travel of assembly 37 between the normal withdrawn work position and the extracted maintenance position, and a given timing angle in the connecting of drive shaft 30 and central shaft 43. Central shaft 43 also comprises a tubular front portion 47 coaxial with axis 27, located frontwards of flange 33, and connected to rear portion 44 by a rear flange 48 of its own, which forms part of joint 36, is interposed between flanges 33 and 41, and has two radial grooves 49, each engaged transversely by a relative pin 35.

Assembly 37 also comprises an angularly fixed tubular support 50 movable axially with shell 38 and central shaft 43, and fitted through with front portion 47 of central shaft 43, to which tubular support 50 is connected in rotary manner by the interposition of bearings 51; and a ball locking device 52 for locking central shaft 43, and therefore assembly 37 as a whole, in said normal withdrawn work position.

Figure 3:
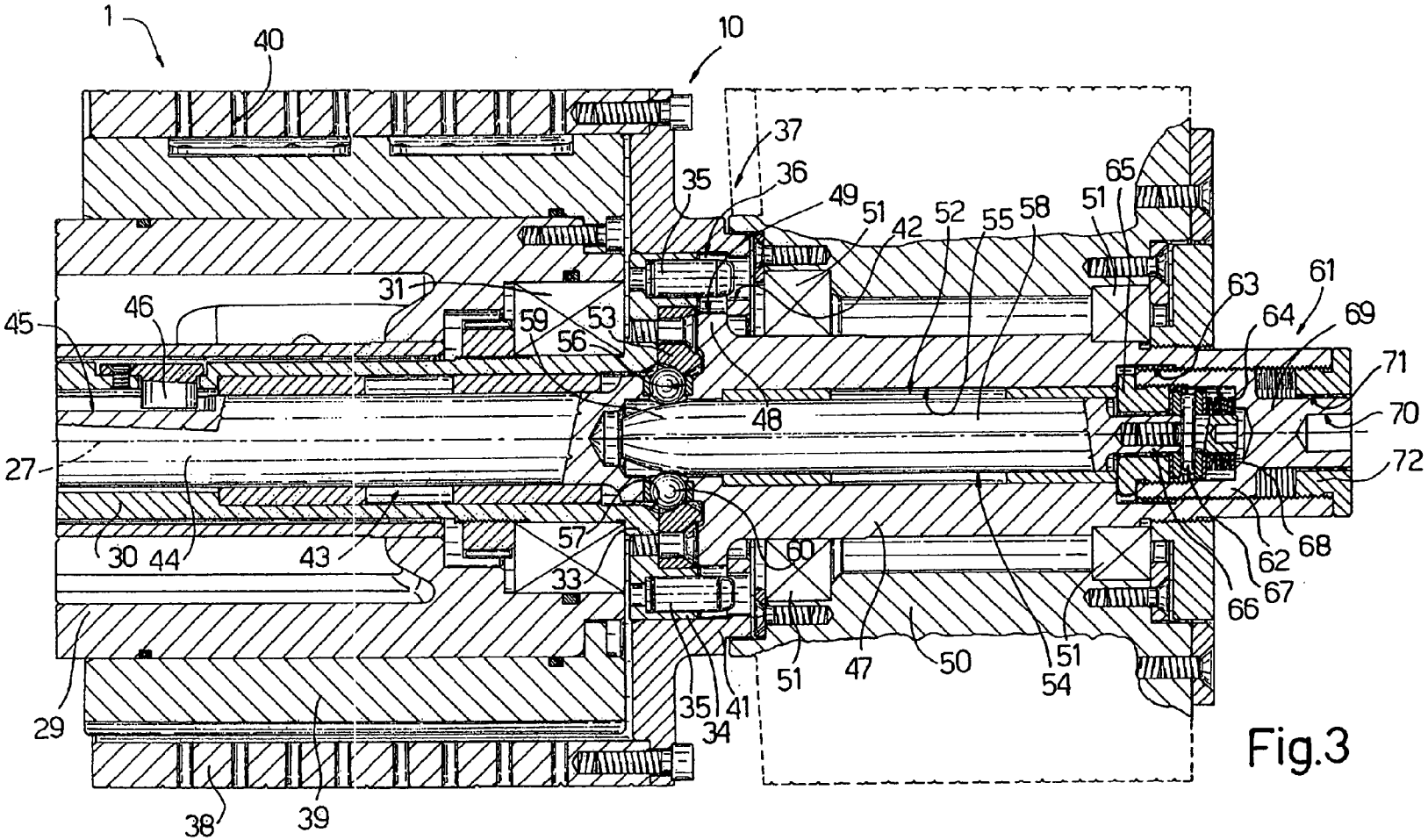
FIG. 3 shows a section of a detail of the FIG. 2 drum.

As shown in FIG. 3, ball locking device 52 comprises a ring 53 located between flanges 33 and 48, connected integrally to flange 33, and housed inside a cavity defined on flange 33 by relative appendix 34.

Ball locking device 52 also comprises a pin 54 coaxial with axis 27 and fitted to slide axially inside a dead hole 55 which is formed axially along front portion 47 of central shaft 43 and partly inside rear portion 44, and has two coaxial radial holes 56 located astride a mating plane of flange 33 and ring 53, and communicating with an annular, substantially elliptical-section groove 57 formed partly on the inner surface of flange 33 and partly on the inner surface of ring 53. Pin 54 comprises a front portion 58 having an outside diameter approximately equal to but no larger than the inside diameter of hole 55; and a substantially truncated-cone-shaped rear portion 59.

Ball locking device 52 also comprises two balls 60, each of which is housed in rolling manner inside a respective hole 56 and is larger in diameter than the length of hole 56 so that, when positioned contacting the bottom of annular groove 57, a portion of each ball 60 projects inside hole 55 by a distance which is smaller, by more than the depth of annular groove 57, than the difference between the radii of the two ends of rear portion 59.

Ball locking device 52 also comprises an adjusting device 61 for adjusting the axial position of pin 54 between a withdrawn lock position (FIGS. 2 and 3) in which substantially the whole of rear portion 59 of pin 54 extends rearwards of holes 56, and a forward release position (FIG. 4) in which only the end of rear portion 59 is located in front of holes 56.

As shown more clearly in FIG. 3, adjusting device 61 comprises a threaded cap 62 which engages a thread formed along a wider front end portion 63 of hole 55, and has a rear cavity 64 closed by a threaded cap 65 having an axial through hole engaged in axially sliding manner by a rear axial appendix 66 of pin 54. Appendix 66 penetrates inside cavity 64 and is fitted, inside cavity 64, with a contrasting member 67 for preventing withdrawal of appendix 66 from cap 65, and which cooperates with a preloading device defined by a pack of Belleville washers 68 compressed between cap 65 and the end of cavity 64. At the front, cap 62 has an axial appendix 69, which has a socket 70 for an Allen wrench at the front end and engages in sliding manner an axial hole 71 formed in a further threaded cap 72, which is screwed inside wider front end portion 63 of hole 55 and acts as a stop for cap 62 and, therefore, pin 54.

Figure 4:
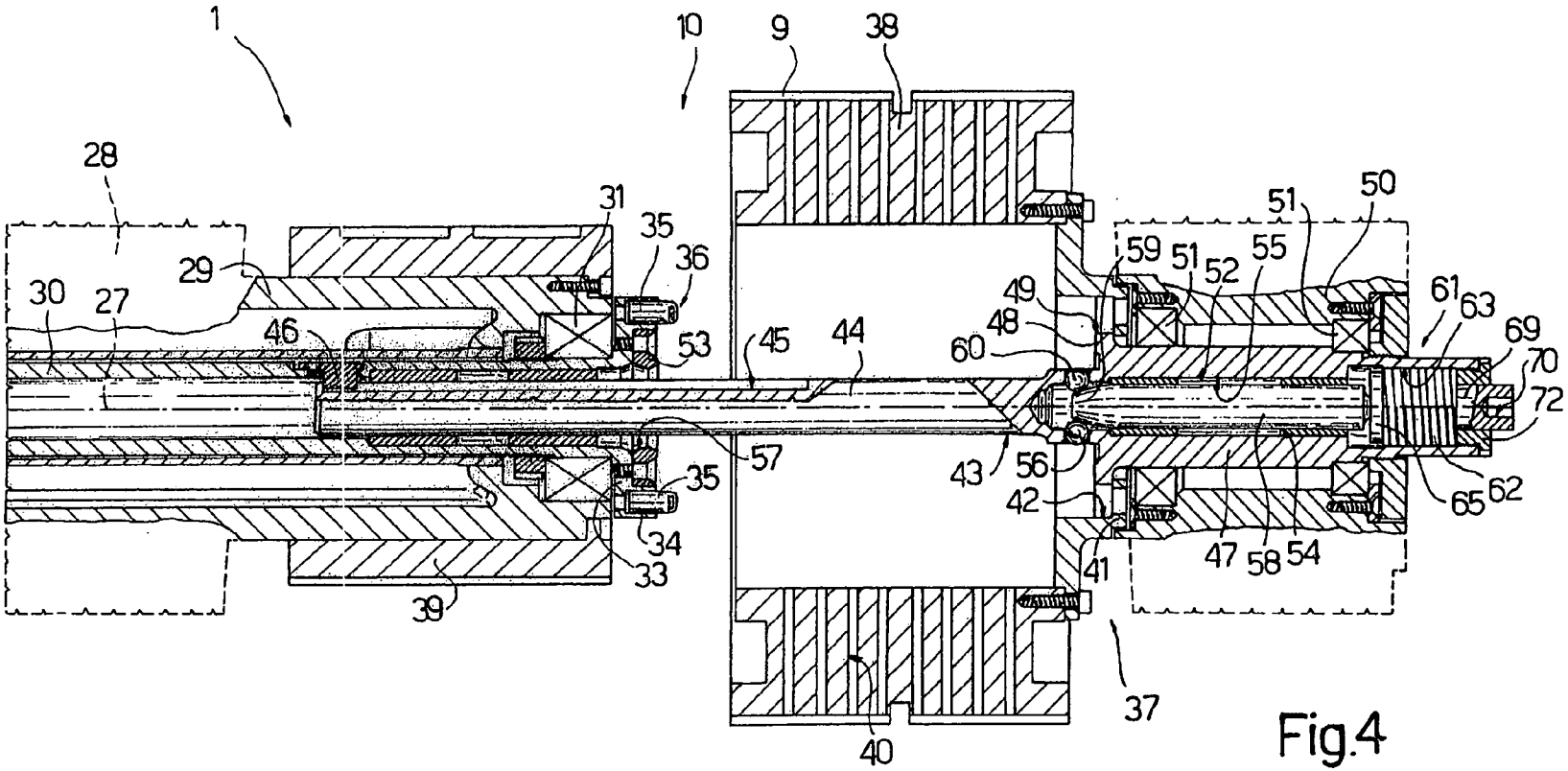
FIG. 4 shows a section of the FIG. 2 drum in a second configuration.

In actual use, when cap 62 is unscrewed, so that it slides axially with respect to front portion 47 from the FIG. 3 to the FIG. 4 position, pin 54 slides axially inside hole 55 from the withdrawn lock position, in which truncated-cone-shaped rear portion 59 presses balls 60 against the bottom of groove 57 (FIGS. 2 and 3), to the forward release position, in which rear portion 59 is positioned with its narrower end in front of holes 56, no longer exerting any pressure of balls 60 (FIG. 4), but simply retaining balls 60 inside respective holes 56.

When pull is then exerted on the front of assembly 37, each ball 60, by contrast with the inner surface of ring 53, moves radially inwards of hole 55, while still remaining inside respective hole 56 but disengaging annular groove 57, thus enabling withdrawal of rear portion 44 from drive shaft 30 and, therefore, of assembly 37 from the rest of drum 10.

The extraction travel enabling shell 38 to be positioned in front of and outwards of the adjacent drums is substantially equal to the travel, along groove 45, of tongue 46, which, besides defining the fully extracted position of assembly 37, also prevents accidental rotation of assembly 37 with respect to drive shaft 30 when performing maintenance and cleaning operations, and so maintains alignment of pins 35 and relative grooves 49, and the timing of seats 9 with respect to the seats of the adjacent drums.

Once maintenance and cleaning are completed, assembly 37 is restored to the normal withdrawn work position by pushing rear portion 44 of central shaft 43 fully inside drive shaft 30, and then screwing down cap 62 to reset ball locking device 52.

In connection with the above, it should be pointed out that central shaft 43 combines with drive shaft 30 to form a telescopic guide-slide coupling, which may be replaced by any other similar telescopic coupling capable not only of withdrawing shell 38 to make it easily accessible from the outside, but also of keeping shell 38 resting on drive shaft 30, even in the extracted maintenance position, of limiting the extraction travel of shell 38 to prevent detachment of shell 38 from drive shaft 30, of maintaining the timing angle in the connection of shell 38 and drive shaft 30, and of disconnecting shell 38, as regards the drive torque, from drive shaft 30 using a face joint, such as joint 36, when shell 38 is extracted.

To simplify maintenance and cleaning, the shell (not shown) of each of the drums in FIG. 1 may obviously be made extractable in the same way as described relative to drum 10.

The invention claimed is:

1. A drum for a filter-tipped cigarette manufacturing machine, said drum being fitted to and projecting from a frame of said manufacturing machine, and which comprises a drive shaft, an outer shell supported by the drive shaft and connected to the drive shaft to rotate with the drive shaft, about an axis having a number of external axial seats, each for retaining a respective elongated tobacco article and connected in axially sliding manner to the drive shaft;

axial guide-slide means interposed between the shell and the drive shaft to permit axial travel of the shell, with respect to the drive shaft, between a withdrawn work position and an extracted maintenance position, in which the shell remains supported by the drive shaft; and releasable locking means for axially locking the shell, and and stop means coupled to said axial guide-slide means for limiting to a given length said travel into said extracted maintenance position.

2. A drum as claimed in claim 1, wherein said axial guide-slide means are telescopic guide-slide means.

3. A drum as claimed in claim 1, wherein said axial guide-slide means comprise angular connecting means for maintaining a given timing angle of said shell with respect to said drive shaft when the shell is moved axially from said withdrawn work position.

4. A drum as claimed in claim 1, wherein a releasable power joint is interposed between said drive shaft and said shell to permit transmission of a drive torque to the shell when the shell is in said withdrawn work position.

5. The drum as claimed in claim 4, wherein said power joint is an axially releasable face joint.

6. The drum as claimed in claim 4, wherein said power joint is a pin-socket type joint.

7. A drum as claimed in claim 1, wherein said axial guide-slide means comprise a central shaft coaxial with said axis, extending through said shell, integral with said shell, and connected telescopically to said drive shaft to perform said axial travel with respect to the drive shaft; said locking means locking said central shaft axially with respect to said drive shaft when said shell is in said withdrawn work position.

8. The drum as claimed in claim 7, wherein said drive shaft is a tubular shaft engaged in axially sliding manner by said central shaft.

9. The drum as claimed in claim 8, wherein said central shaft comprises a tubular portion having a central axial hole and supporting said locking means.

10. The drum as claimed in claim 9, wherein said central axial bole has though radial holes of a given length; said locking means comprising balls housed in rotting manner inside respective said radial holes and larger in diameter than said length; an annular groove coaxial with said axis, facing said radial holes, and integral with said drive shaft; a push pin mounted to slide axially inside said central axial hole, and having a tapered portion cooperating with said balls; and an adjusting device for releasably locking said push pin in a work position in which said tapered portion cooperates with said balls to retain them inside said annular groove.

11. A drum as claimed in claim 10, wherein said adjusting device comprises elastic means for axially preloading said push pin.

12. The drum as claimed in claim 7, wherein said locking means a radial ball locking means.

13. The drum as claimed in claim 7, wherein, with respect to said drive shaft and said central shaft, one thereof comprises an axial groove, and the other integrally supports integrally a tongue engaging said groove in axially sliding manner to maintain a given timing angle of said shell with respect to said drive shaft, regardless of the axial position, during said travel, of said central shaft with respect to said drive shaft.

14. The drum as claimed in claim 13, wherein said groove is axially bounded by end shoulders cooperating with said tongue to define a length of said travel.

15. A drum for a filter-tipped cigarette manufacturing machine, said drum being fitted to and projecting from a frame of said manufacturing machine which comprises:

a drive shaft, and an outer shell supported by the drive shaft, and connected to the drive shaft to rotate, with the drive shaft, about an axis, having a number of external axial seats, each for retaining a respective elongated tobacco article and connected in axially sliding manner to the drive shaft;

axial guide-slide means interposed between the shell and the drive shaft to permit axial travel of the shell, with respect to the drive shaft, between a withdrawn work position and an extracted maintenance position, in which the shell remains supported by the drive shaft; and releasable locking means to axially lock the shell;

wherein said axial guide-slide means comprise a central shaft coaxial with said axis, extending through said shell, integral with said shell, and connected telescopically to said drive shaft to perform said axial travel with respect to the drive shaft; said locking means locking said central shaft axially with respect to said drive shaft when said shell is in said withdrawn work position;

wherein said drive shaft is a tubular shaft engaged in axially sliding manner by said central shaft;

wherein said central shaft comprises a tubular portion having a central axial hole and supporting said locking means; and wherein said central axial hole has through radial holes of a given length; said locking means comprising balls housed in rolling manner inside respective said radial holes and larger in diameter than said length; an annular groove coaxial with said axis, facing said radial holes, and integral with said drive shaft; a push pin mounted to slide axially inside said central axial hole, and having a tapered portion cooperating with said balls; and an adjusting device for releasably locking said push pin in a work position in which said tapered portion cooperates with said balls to retain them inside said annular groove.

16. The drum as claimed in claim 15, wherein the adjusting device comprises elastic means for axially preloading said push pin.

* * * * *